US006002318A

United States Patent [19]

Werner et al.

[11] Patent Number: 6,002,318

[45] **Date of Patent: *Dec. 14, 1999**

[54] DEVICE FOR DISSIPATING HEAT FROM FERRITE CORES OF INDUCTIVE COMPONENTS

[75] Inventors: Tristan Werner, Munich; Mauricio Esguerra, Unterhaching, both of Germany

[73] Assignee: Siemens Aktiengesellschaft, Munich, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/922,631

[22] Filed: Sep. 3, 1997

[30] Foreign Application Priority Data

Sep. 12, 1996 [DE] Germany ..... 196 37 211

[51] Int. Cl.[6] ..... H01F 27/08; H01F 17/00

[52] U.S. Cl. ..... 336/61; 336/177; 336/83

[58] Field of Search ..... 336/61, 83, 177

[56] References Cited

U.S. PATENT DOCUMENTS

| | | | |
|---|---|---|---|
| 2,770,785 | 11/1956 | Haagens et al. | 336/61 |
| 2,990,524 | 6/1961 | O'Meara et al. | 333/24 |
| 3,179,908 | 4/1965 | Peabody | 336/61 |
| 3,710,187 | 1/1973 | Harnden, Jr. | 317/15 |
| 4,379,273 | 4/1983 | Bender | 333/32 |
| 5,532,667 | 7/1996 | Haertling et al. | 336/177 |
| 5,726,858 | 3/1998 | Smith et al. | 336/61 |

FOREIGN PATENT DOCUMENTS 0 532 360 A1 9/1992 European Pat. Off. .

OTHER PUBLICATIONS

IBM Technical Disclosure Bulletin article entitled: "Conduction Cooled Ferrite Core in a High Power Transformer", vol. 36, No. 098, Sep. 1993.

*Primary Examiner*—Michael L. Gellner
*Assistant Examiner*—Anh Mai
*Attorney, Agent, or Firm*—Hill & Simpson

[57] ABSTRACT

A device for dissipating heat from ferrite cores of inductive components is provided. Specifically, in order to dissipate heat from cores made from ferromagnetic material for inductive components, an electrically and thermally conductive layer which can be coupled thermally to a heat sink is provided on prescribed surface areas of the core.

18 Claims, 1 Drawing Sheet

DEVICE FOR DISSIPATING HEAT FROM FERRITE CORES OF INDUCTIVE COMPONENTS

BACKGROUND OF THE INVENTION

The present invention relates to a device for dissipating heat, and more specifically to a device for dissipating heat from ferrite cores of inductive components.

It is known from EP 0 532 360 A1 to provide in the region of a magnet core and of windings of a transformer an electrically conducting medium which forms a restriction in which the magnetic flux emanating from the magnet core and the windings is concentrated. Leakage inductances of transformers can be reduced or controlled using this construction. The electrically conducting medium can, for example, be applied in the form of a metal layer to a magnet core, the metal layer being slit to prevent an electric short circuit.

However, while the employment of an electrically conducting medium, such as a metal layer, is useful in reducing or controlling leakage inductances, heat accumulation in transformers remains a problem. Accordingly, there is a need for an improved method and construction for dissipating heat from magnetic cores and windings of transformers.

SUMMARY OF THE INVENTION

It is the object of the present invention to configure metal layers of the type mentioned above so that they are suitable for dissipating heat from ferromagnetic cores of inductive components.

According to the invention, this object is achieved in a device of the type disclosed herein and in the figures.

In accordance with the present invention, a device is provided for dissipating heat from a ferromagnetic core. The core has an exposed surface and the core is typically the type of core incorporated into inductive components such as transformers. The heat dissipating device of the present invention comprises a layer of electrically and thermally conductive material applied to the exposed surface of the core. The layer is connected to a heat sink. The layer further has a higher thermal conductivity than the material of the core so that the layer conducts heat from the core to the heat sink.

In an embodiment, the layer comprises metal.

In an embodiment, the layer comprises copper, silver or mixtures thereof.

In an embodiment, the layer further comprises a plurality of interruptions, gaps or recesses so the induction of electric current in closed electrically conducting pads within the layer is avoided.

In an embodiment, the heat sink comprises a material that is electrically and thermally conductive.

In an embodiment, the thermal conductivity of the layer is greater than the thermal conductivity of the core by a factor of about 100.

In an embodiment, the present invention provides a method of dissipating heat from a ferromagnetic core having an exposed surface area, the method comprising the steps of coating the surface of the core with a layer comprising an electrically and thermally conductive material whereby the thermal conductivity of the layer is greater than the thermal conductivity of the core by a factor of about 100, followed by the step of connecting the layer to a heat sink so that the layer transmits heat from the core to the heat sink.

It is therefore an advantage of the present invention to provide an improved electrical transformer which can dissipate heat.

Another advantage of the present invention is to provide a device for dissipating heat from ferromagnetic cores of inductive components.

Still another advantage of the present invention is to provide an improved coating for ferromagnetic cores which enables heat to be dissipated away from the core.

Yet another advantage of the present invention is to provide an improved method of dissipating heat from ferromagnetic cores.

Other objects and advantages of the present invention will become apparent upon reading the following detailed description and appended claims, and upon reference to the accompanying drawings.

BRIEF DESCRIPTION OF THE DRAWING

The invention is explained in detail below with the aid of exemplary embodiments in accordance with the figures of the drawing, in which.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENT

Figure 1:
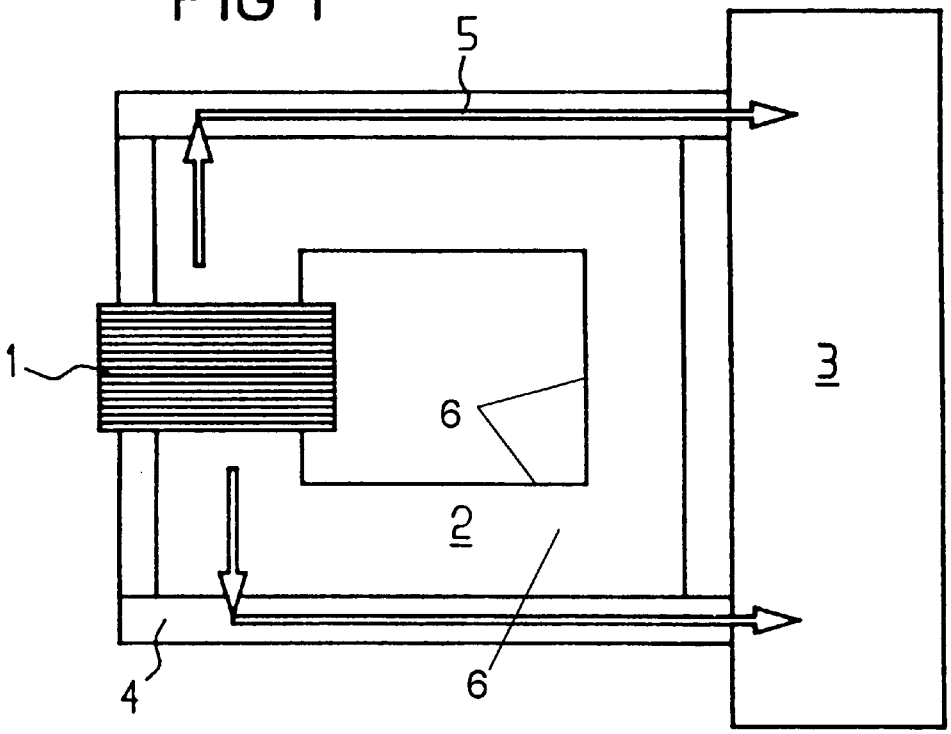
FIG. 1 is a schematic representation of a heat dissipating component according to the present invention incorporated into transformer.

In accordance with FIG. 1, an inductive component is formed in principle by a core 2 made from ferromagnetic material—generally a ferrite core—and a winding 1 provided thereon.

In order to dissipate heat, the invention provides on the ferrite core 2 a layer 4 which is made from electrically and thermally conductive material and is coupled to a heat sink in the form of a dissipator 3. The heat flux is indicated diagrammatically by arrowed lines 5.

In order to prevent the induction of electric currents in the electrically and thermally conductive layer 4, it is provided with interruptions, gaps or recessed areas so that no closed electric current paths can form. Such interruptions are represented in FIG. 1 at the inner surfaces 6 of the core 2 and may be seen from the embodiment according to FIG. 2, which is still to be explained below.

Electrically and thermally conductive layers of the type explained above can, for example, be applied galvanically to a ferrite core, the procedure being, in particular, firstly to apply a thin layer a few $\mu$m thick by chemical electroplating and then to thicken the layer electrogalvanically. In order to deposit the layers on ferritic materials, the chemical properties of the solution baths, in particular the pH value, are matched to the material. The aim in this is not to impair the electromagnetic and mechanical properties of the ferritic material.

As already explained above, in order to prevent the induction of electric currents in the electrically and thermally conductive layer, provision is made for interruptions which can be produced, for example, by grinding the pole faces of ferrite cores, by printing over with etch-resistant masks and subsequently etching, or by laser cutting. Such partially coated cores have the advantage that low electrical and thermal transfer resistances are achieved between the component and the layer.

It is possible by the use of such layers to realize optimum thermal coupling, for example by soldering, to heat sinks such as, for example, the dissipator 3 according to FIG. 1. What is decisive here is the far higher conductivity of metals, for example of copper or silver, by comparison with ferritic materials. Differences in thermal conductivity by a factor of 100 can be achieved. The electrically and thermally conductive layer 4 approximately constitutes an isotherm, with the result that the temperature gradient in the core interior is steeper in the direction of the core surface than in the case of an uncoated core. Heat therefore flows essentially along the electrically and thermally conductive layer in the direction of the dissipator instead of via the thermally poorly conducting ferritic material in the case of an uncoated core.

Figure 2:
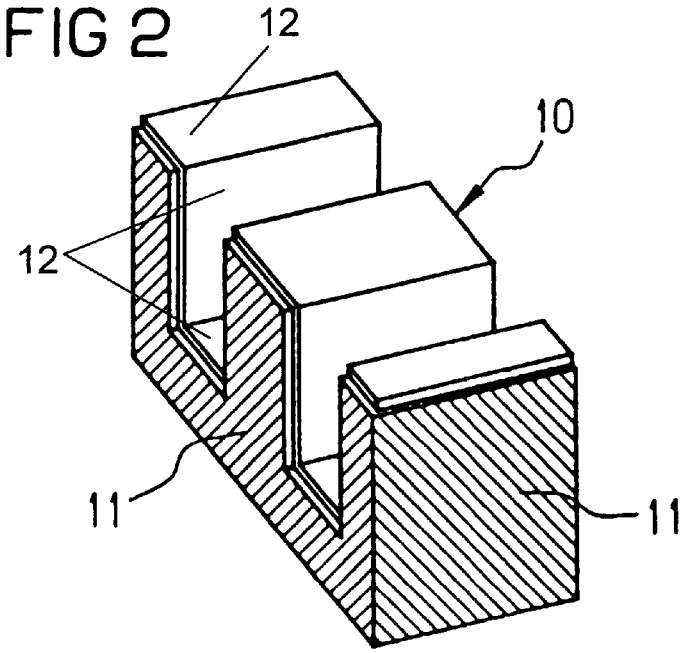
FIG. 2 is a perspective view of a core made from ferromagnetic material and having a thermally conducting layer suitable for heat dissipation in accordance with the present invention.

A possible embodiment of an interrupted electrically and thermally conductive layer corresponding to the layer 4 according to FIG. 1 is represented in FIG. 2 for an E ferrite core 10 in which a thermally and electrically conductive layer 11 is provided on prescribed surface regions but not on the interior surface regions 12 thereby providing the requisite interruptions.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed:

1. A device for dissipating heat from a ferromagnetic core having a surface, a portion of the core being wrapped with a winding, the core being incorporated into inductive components, the device comprising:

a metallic layer comprising electrically and thermally conductive material, the layer being coated directly on a portion of the surface of the core with a portion of the core surface remaining free of the electrically and thermally conductive material, a portion of the layer being disposed between the core and the winding, the layer further being connected to a heat sink.

2. The device of claim 1 wherein the layer comprises metal.

3. The device of claim 2 wherein the metal comprises copper.

4. The device of claim 2 wherein the metal comprises silver.

5. The device of claim 1 wherein the layer in combination with the portion of the core surface that is free of the electrically and thermally conductive material which prevents an induction of an electrical current in a closed electrical path.

6. The device of claim 1 wherein the heat sink comprises a structure comprises an electrically and thermally conductive material.

7. The device of claim 6 wherein the heat sink comprises metal.

8. The device of claim 7 wherein the metal comprises copper.

9. The device of claim 7 wherein the metal comprises silver.

10. A transformer comprising:

a ferromagnetic core having a surface, a portion of the core being wrapped with a winding, a portion of the surface being coated directly with a metallic layer comprising electrically and thermally conductive material, a portion of the surface being free of the electrically and thermally conductive material, the core having a thermal conductivity, the layer having a thermal conductivity, the thermal conductivity of the layer being greater than the thermal conductivity of the core, a portion of the layer being disposed between the core and the winding, the layer further being connected to a heat sink whereby the layer transmits heat from the core to the heat sink.

11. The device of claim 10 wherein the layer comprises metal.

12. The device of claim 11 wherein the metal is selected from the group consisting of copper, silver and mixtures thereof.

13. The device of claim 10 wherein the heat sink comprises a structure comprising an electrically and thermally conductive material.

14. The device of claim 13 wherein the heat sink comprises metal.

15. The device of claim 14 wherein the metal is selected from the group consisting of copper, silver and mixtures thereof.

16. The device of claim 10 wherein the thermal conductivity of the layer is greater than the thermal conductivity of the core by a factor of 100.

17. A method of dissipating heat from a ferromagnetic core having a surface, a portion of the core being wrapped with a winding, the method comprising the steps of:

coating a portion of the surface of the core directly with a layer comprising electrically and thermally conductive material while leaving a remaining portion of the surface free of the electrically and thermally conductive material, the core having a thermal conductivity, the layer having a thermal conductivity, the thermal conductivity of the layer being greater than the thermal conductivity of the core by a factor of 100, wrapping the core with a winding, the winding covering a portion of the layer, connecting the layer further to a heat sink whereby the layer transmits heat from the core to the heat sink.

18. The method of claim 17 wherein the layer comprises a metal selected from the group consisting of silver, copper and mixtures thereof.

* * * * *